US011286088B2

(12) United States Patent
Kittmann

(10) Patent No.: US 11,286,088 B2
(45) Date of Patent: Mar. 29, 2022

(54) SNAP CLOSURE WITH TAMPER-EVIDENT SAFETY MEANS

(71) Applicant: Roland Kittmann, Reichertshausen (DE)

(72) Inventor: Roland Kittmann, Reichertshausen (DE)

( * ) Notice: Subject to any disclaimer, the term of this patent is extended or adjusted under 35 U.S.C. 154(b) by 89 days.

(21) Appl. No.: 16/327,461

(22) PCT Filed: Aug. 23, 2017

(86) PCT No.: PCT/DE2017/100709
§ 371 (c)(1),
(2) Date: Feb. 22, 2019

(87) PCT Pub. No.: WO2018/036592
PCT Pub. Date: Mar. 1, 2018

(65) Prior Publication Data

US 2019/0193900 A1 Jun. 27, 2019

(30) Foreign Application Priority Data

Aug. 26, 2016 (DE) ..... 102016115950.6

(51) Int. Cl.
*B65D 43/10* (2006.01)
*B65D 43/02* (2006.01)

(52) U.S. Cl.
CPC ..... *B65D 43/0237* (2013.01); *B65D 43/0235* (2013.01); *B65D 2401/15* (2020.05);
(Continued)

(58) Field of Classification Search
CPC ..... B65D 43/0237; B65D 43/0235; B65D 2401/15; B65D 2401/25;
(Continued)

(56) References Cited

U.S. PATENT DOCUMENTS 2,049,228 A * 7/1936 Sebell ..... B65D 43/22 220/281
3,080,993 A 3/1963 Livingstone
(Continued)

FOREIGN PATENT DOCUMENTS

DE 19645263 A1 5/1998
DE 102015103036 A1 9/2016
(Continued)

*Primary Examiner* — Don M Anderson
*Assistant Examiner* — Elizabeth J Volz
(74) *Attorney, Agent, or Firm* — Laurence A. Greenberg; Werner H. Stemer; Ralph E. Locher

(57) ABSTRACT

A cover operates with a bistable snap-fit mechanism for positioning on a closable opening of a container or on another element to be closed by the cover. The cover and/or a container wall region has fitted thereon a tamper-evident sealing element to be removed when opening the container for the first time, which, prior to being removed, blocks deformation of the front wall necessary for changeover between the two bistable states and/or prevents an expansion portion necessary for the snap-fit mechanism, from bringing about alteration to the outer circumference of the cover necessary for deformation of the front wall of the cover between the two bistable states. As an alternative, or in addition, it is also possible for a handle member, necessary for pulling off the cover, to be configured such that it can only be used once the tamper-evident sealing has been successfully removed.

16 Claims, 13 Drawing Sheets

(52) U.S. Cl.
CPC .. *B65D 2401/25* (2020.05); *B65D 2543/0037* (2013.01); *B65D 2543/0049* (2013.01); *B65D 2543/00092* (2013.01); *B65D 2543/00296* (2013.01); *B65D 2543/00351* (2013.01); *B65D 2543/00407* (2013.01); *B65D 2543/00527* (2013.01); *B65D 2543/00537* (2013.01); *B65D 2543/00546* (2013.01); *B65D 2543/00851* (2013.01); *B65D 2543/00972* (2013.01)

(58) Field of Classification Search
CPC ..... B65D 2543/00092; B65D 2543/00296; B65D 2543/00351; B65D 2543/0037; B65D 2543/00407; B65D 2543/0079; B65D 2543/00527; B65D 2543/00537; B65D 2543/00546; B65D 2543/00851; B65D 2543/00972; B65D 81/2038; B65D 2251/0093
USPC ..... 220/212.5, 378, 281, 780, 203.09; 215/270, 246
See application file for complete search history.

(56) References Cited

U.S. PATENT DOCUMENTS

| | | | | |
|---|---|---|---|---|
| 3,559,843 | A * | 2/1971 | Kern | B65D 43/0222 220/281 |
| 5,762,217 | A | 6/1998 | Ohmi et al. | |
| 5,799,814 | A | 9/1998 | Schaefer et al. | |
| 6,260,723 | B1 | 7/2001 | Bergholtz | |
| 8,820,553 | B2 | 9/2014 | Endert | |
| 2005/0035081 | A1 * | 2/2005 | Fitch | B65D 55/0854 215/246 |
| 2005/0039416 | A1 * | 2/2005 | Hidding | B65D 1/023 53/397 |
| 2007/0272571 | A1 * | 11/2007 | Czopor | B65D 5/54 206/340 |
| 2010/0237071 | A1 | 9/2010 | Lee | |
| 2012/0325768 | A1 * | 12/2012 | Biesecker | B65D 51/18 215/206 |
| 2018/0312307 | A1 | 11/2018 | Kittmann | |

FOREIGN PATENT DOCUMENTS

| | | | | |
|---|---|---|---|---|
| DE | 202015105951 | U1 | 3/2017 | |
| GB | 845457 | A | 8/1960 | |
| GB | 1212270 | * | 11/1970 | B65D 43/0212 |
| GB | 1212270 | A | 11/1970 | |
| GB | 2395710 | A | 6/2004 | |
| JP | H08156961 | A | 6/1996 | |
| JP | H09221155 | A | 8/1997 | |
| JP | 2000302146 | A | 10/2000 | |
| JP | 2002193289 | A | 7/2002 | |
| JP | 2010505709 | A | 2/2010 | |
| JP | 2011521854 | A | 7/2011 | |

* cited by examiner

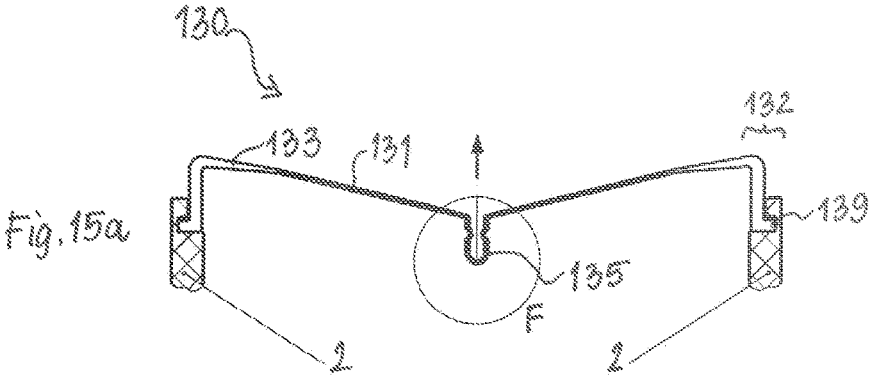
Fig. 15a
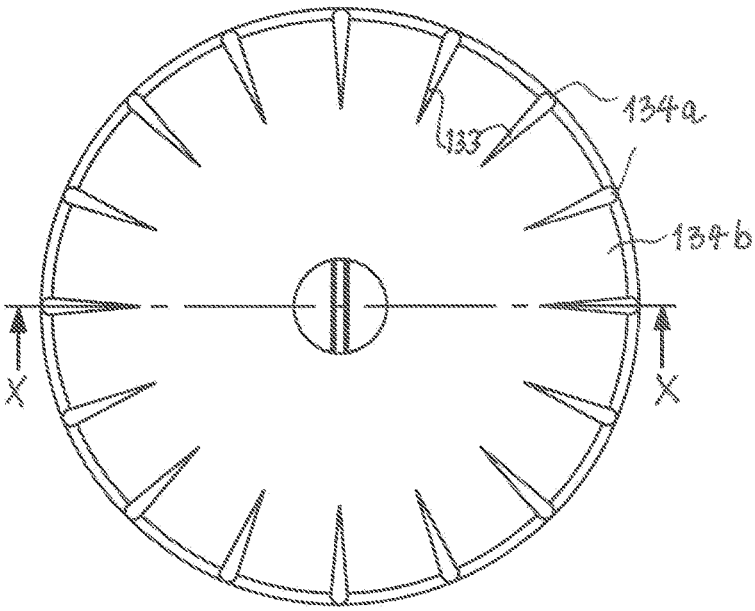
Fig. 15b
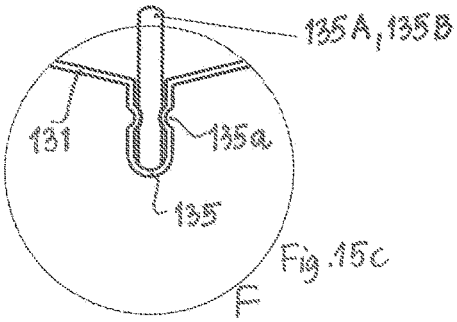
Fig. 15c
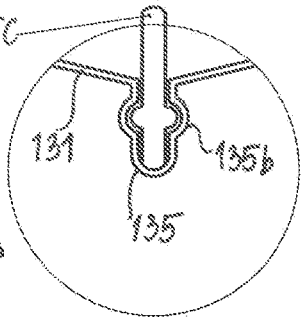
Fig. 15h
Fig. 15d
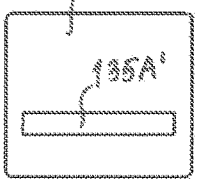
Fig. 15e
Fig. 15f
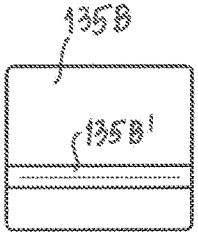
Fig. 15g
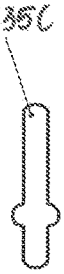
Fig. 15i
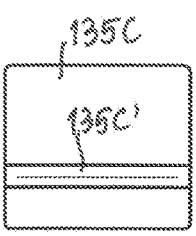
Fig. 15j

SNAP CLOSURE WITH TAMPER-EVIDENT SAFETY MEANS

BACKGROUND OF THE INVENTION

Field of the Invention:

There is a general need in packaging industry for reclosable containers, especially for food or the like. The container opening should be closable with a cover—if possible, gas- and liquid-tight. In particular, the cover should be designed as a so-called tamper-evident closure, i.e. it should be immediately apparent to the customer when the container is opened for the first time, whether the container is still in the condition of original delivery, or whether it has already been opened.

For this purpose, conventional packaging solutions provide, for example, an outer groove which extends annularly around the peripheral edge of the container opening and into which the outer peripheral edge of the cover protrudes such far that it cannot be grasped by hand to open the cover. Only after removing a ring-segment-shaped part of the outer groove the customer can pull on the then exposed portion of the outer circumference of the cover to pull it out upwards from the groove in order to get to the contents of the container. The removable part of the outer groove is marked by appropriate markings and formed as a breakpoint material. It represents a so-called tamper-evident sealing element, because the customer knows after its removal that the container is no longer in its original state, but has already been opened at least once.

SUMMARY OF THE INVENTION

The object of the present invention is to provide an alternative solution for a closure system with tamper-evident sealing element, in particular a cover which is as gas-tight and water-tight as possible, which is suitable for as many types of containers as possible, whose opening and closing mechanism is easy to understand and operate by the customer, and which can be produced as material-saving and cost-efficient as possible.

The object is met by the cover according to to invention. The cover is characterized by a so-called snap-fit mechanism in which the front wall is deformable in a bistable manner between a first state cambered in the direction of attachment and a second state cambered against the direction of attachment. This deformation is accompanied by an enlargement of the cover's outer edge, which is suitable for fastening the cover in a clamping fashion to the container or any other element to be closed by the cover. The tamper-evident sealing element is realized by attaching to the cover or to the container a blocking element which blocks the deformation of the front wall required for the transition between the two bistable states and/or prevents expansion portions at the edge portion of the cover from effecting the deformation of the front wall between the two bistable states which is required to change the outer circumference of the cover. As a result, the cover can only snap back and forth between the two bistable states after the sealing element has been removed.

According to a further aspect of the invention, the object is also met by the further embodiment of the cover according to the invention. This cover is also characterized by the snap-fit mechanism mentioned above, but realizes the tamper-evident seal in that a handle member necessary to lift the cover must first be brought into its functional position.

Thereby, a seal of authenticity is broken and signals to the user that the cover is no longer in its original state.

Preferred embodiments of the cover according to the invention are specified in the subclaims. The invention also relates to a closure system formed from the cover according to the invention and the container with the opening to be closed.

The sealing element is preferably attached to the cover and/or the wall region via a perforation or area of thinned material which is easily recognizable from the outside. Thus, the sealing element can be readily removed by hand when opening the container for the first time, without causing any other sort of damage to the cover or the container.

In principle, it is sufficient if the sealing element extends over at least a part of the front wall and/or the edge portion provided with the expansion portions. The part just needs to be large enough that the sealing element reliably prohibits the deformation of the front wall or the expansion of the expansion portions required for the snap-fit mechanism of the cover. Preferably, however, the sealing element is annularly formed along the entire outer circumference of the cover and in particular formed directly on the outermost outer periphery of the cover.

The snap-fit mechanism of the cover can be realized in that folds are formed at the edge portion which folds extend, when the sealing element is removed, up to the outermost outer edge of the cover and can span, when the cover is snapping over, from their folded state to a spread state, so as to achieve the desired enlargement of the cover's outer circumference.

The snap-fit mechanism is described in more detail in the German patent application DE 10 2015 103 036 A1, the entire content of which is hereby incorporated by reference. The folds can be integrally made of plastic with substantially homogeneous wall thickness in a particularly cost-effective manner by a so-called thermoforming method (also called hot forming, deep drawing or vacuum deep drawing). Suitable basic materials are in particular thin films of thermoplastics such as PET, PS and PP. Alternatively, however, they can also be produced by injection molding, for example, which in particular allows more freedom in the three-dimensional shaping and also allows to produce the expansion portions as expansion grooves or folds formed by different material thicknesses.

Instead of providing the folds, the expansion portions can also be formed of a softer material component than the predominant rest of the edge portions. Such covers can be produced particularly well in a multi-component injection molding process, and are described in detail in the German utility model application DE 20 2015 105 951 U1. The entire content of this application is hereby incorporated by reference as well. Preferred materials for the first (softer) component are: thermoplastic elastomers (TPE) and thermoplastic urethane (TPU). Preferred materials for the second (harder) component are: polycarbonate (PC), acrylonitrile-butadiene-styrene (ABS) and polystyrene (PS).

Irrespective of the specific configuration of the expansion portion, it is important for the present invention that the edge portion is reliably prevented in the original state by the tamper-evident sealing element, which is also referred to in the following as a seal ring in some embodiments, to expand or contract to the extent required for the snap-fit mechanism. The snap-fit function of the cover should only be enabled after removal of the seal ring.

In the present description, the closure element of the opening to be closed is generally referred to as a cover. If the clamping attachment of the cover engages outside on the opening wall, the cover is called a cap; on the other hand, if the cover clamps from inside against the opening wall, it is called a lid.

BRIEF DESCRIPTION OF THE SEVERAL VIEWS OF THE DRAWING

The invention will be explained below with reference to the drawings with reference to several embodiments. Therein:

FIG. 15*a* is a sectional side view of a closure system with a closure cap according to a twelfth embodiment of the present invention in the closed position;

FIG. 15*b* is a plan view of the lid of FIG. 15*a;*

FIG. 15*c* shows the enlarged detail F of FIG. 15*a* with a handle part latched in the front wall;

FIG. 15*d* shows a first variant of a handle part designed for anchoring in the front wall of the cover in a side view;

FIG. 15*e* is a front view of the handle part of FIG. 15*d;*

FIG. 15*f* a second variant of a handle part designed for anchoring in the front wall of the cover in a side view;

FIG. 15*g* is a front view of the handle part of FIG. 15*f;*

FIG. 15*h* shows the enlarged detail F of FIG. 15*a* with a handle part latched in the front wall in a variant of the twelfth embodiment;

FIG. 15*i* is a side view of the handle part adapted for anchoring in the front wall of the lid according to the variant of the twelfth embodiment;

FIG. 15*j* is a front view of the handle part of FIG. 15*i*.

DESCRIPTION OF THE INVENTION

Figure 1A:
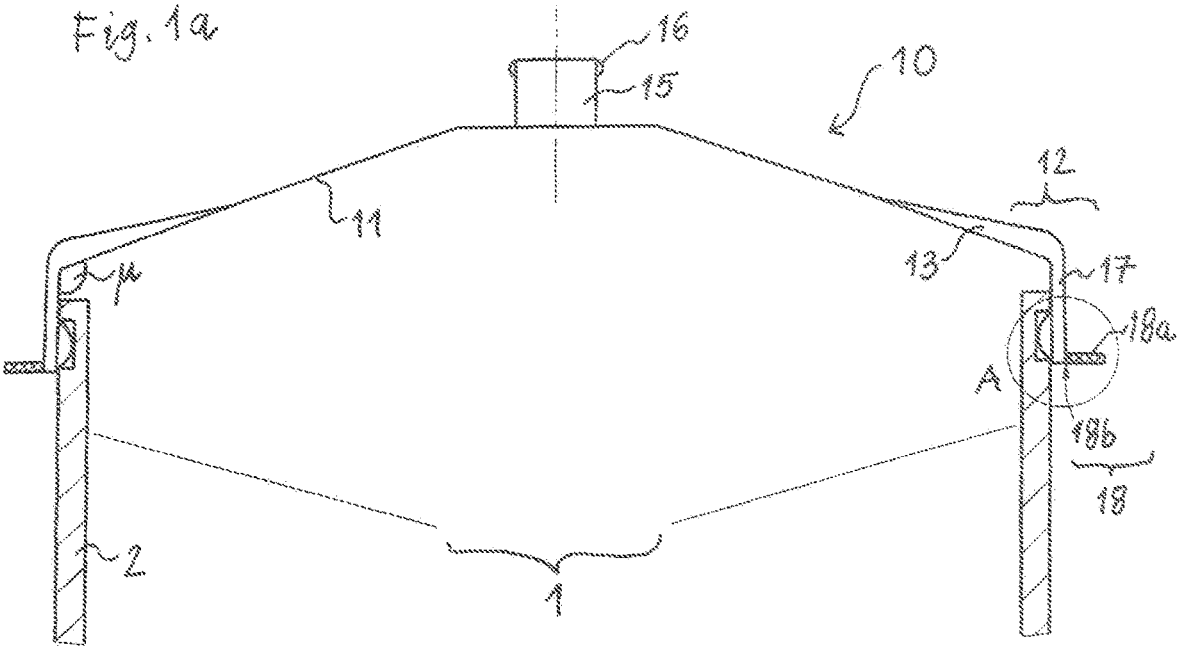
FIG. 1*a* is a cross-sectional view of a closure system according to the present invention with a closure cap according to a first embodiment in the closed position.

FIG. 1*a* shows a cap 10 according to the first embodiment of the invention, which sits in a clamping attachment on the outside of the wall 2 of the container opening 1 to be closed or on another element to be closed by the cover. The cap 10 has a front wall 11 of substantially circular basic shape, at the peripheral edge of which an annular edge portion 12 is formed. The edge portion 12 has a middle portion 17 extending substantially axially, i.e. along the direction of attachment, and a lip portion 18 extending transversal thereto, i.e. in the radial direction. Radially inwardly projecting locking knobs 19 are formed at the middle portion 17, which are designed for a clamping engagement into an annular groove 3 on the outer circumference of the opening wall 2.

In order to keep the angle μ, which the front wall 11 and the edge portion 12 include in their transition region, constant for both bistable states, the cap material should have sufficient rigidity. This is achieved according to the invention in a cover produced with a thermoforming process with substantially homogeneous wall thickness by forming reinforcement ribs 13 in the transition region between the front wall 11 and the edge portion 12. In other manufacturing processes, for example an injection molding process, the reinforcement regions 13 can also be designed as regions of increased material thickness. In a multi-component injection molding process, these portions may also be formed by using a harder material component. FIG. 1*a* shows a cross-section through the cap 10 in a circumferential section in which a reinforcement region 13 is provided. However, the reinforcement regions may be provided only intermittently at some peripheral regions, while the transition region between the front wall 11 and edge portion 12 otherwise remains unstiffened.

On the front wall 11, there is further formed a cylindrical handle member 15 (so-called gripping dome). At this dome, the cap 10 can be gripped readily and can be drawn from the opening 1 in the axial direction without tilting. To improve the grip, additional gripping protrusions or knobs 16 may be provided for increasing the slip resistance at a peripheral edge of the handle member 15.

Figure 1B:
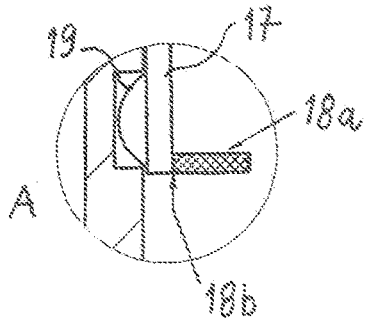
FIG. 1*b* is an enlarged detail A of FIG. 1*a;*

As is shown in more detail in FIG. 1*b*, the lip portion 18 of the edge portion 12 according to the invention has a seal ring 18*a* that can be separated by a material thinning or perforation 18*b* designed as a predetermined breaking point. The seal ring 18*a* is connected to the middle portion 17 via the material perforation 18*b* and is intended to prevent (not shown in the cross-section of the drawing—but see FIGS. 9 and 10) expansion portions in the middle portion 17 from widening when the gripping dome 15 is pressed down. For this, it is important that the seal ring 18*a* does not include such expansion portions, i.e., when the cap 10 is produced in a multi-component injection molding process, that the seal ring is formed at least predominantly and preferably continuously from a harder material component than the expansion portions or, when produced in a deep-drawing process, that the seal ring has no foldings that extend to the outermost peripheral edge of the cover 10.

Figure 1C:
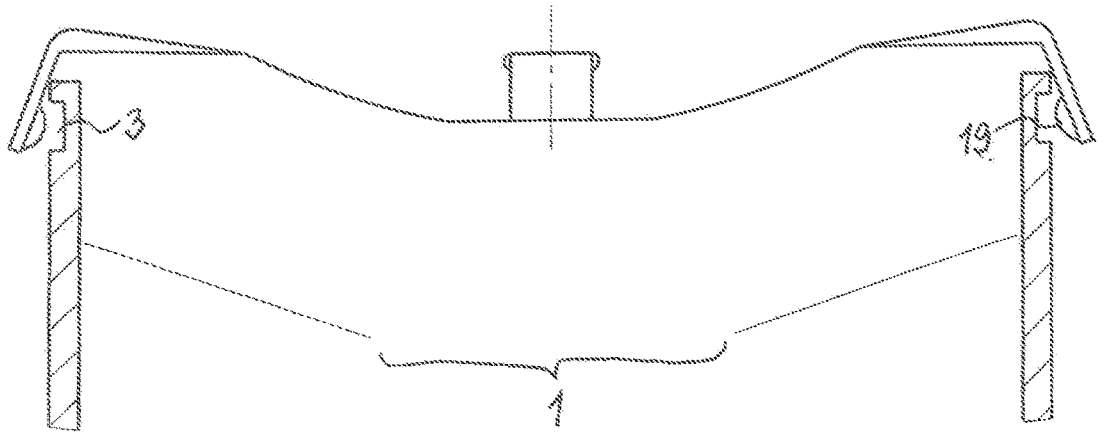
FIG. 1*c* shows the closure system according to FIG. 1*a* in the open position.

As shown in FIG. 1*c*, the cap 10 should be able to deform after removal of the seal ring 18*a* into the second bistable state in which the front wall 11 snaps into a concave shape, and the edge portion 12 expands while maintaining an unchanged transition angle μ. The expansion of the edge portion 12 is only possible because, in the absence of seal ring 18*a*, an expansion of the expansion portions is no longer prevented. By holding the edge portion 12 and simultaneously lifting the gripping dome 15, the cover shown in FIG. 1*c* can be brought back into its closed position.

The second embodiment of the closure cap 20 will be explained with reference to FIGS. 2*a-d*. Function and design of the front wall 21, the edge portion 22, the reinforcement regions 23, the gripping dome 25 and the gripping knobs 26 are the same as in the first embodiment shown in FIG. 1 and will not be explained again. A difference to the first embodiment resides only in the transition from the middle portion 27 into the lip portion 28. This is shown in two variants, wherein the variant shown in FIG. 2*c* can be produced well in a thermoforming process, while the variant shown in FIG. 2*b* may be produced in an injection molding process, preferably in a multi-component injection molding process.

Figure 2A:
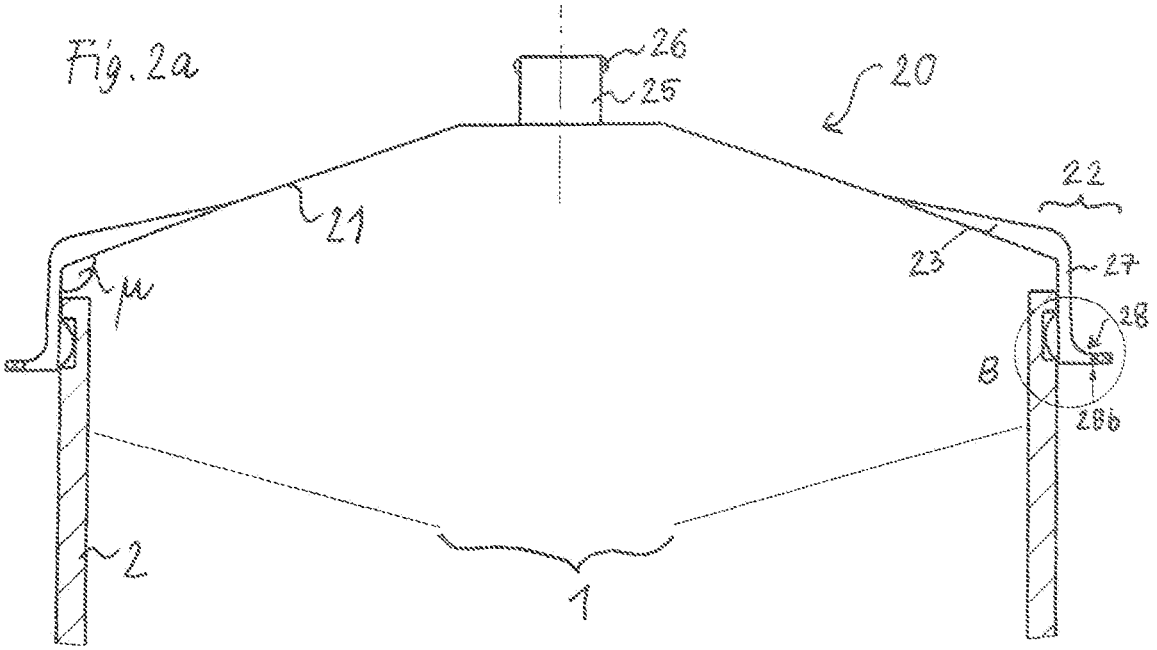
FIG. 2*a* shows a cross-sectional view of a closure system according to the present invention with a closure cap according to a second embodiment in the closed position.
Figure 2C:
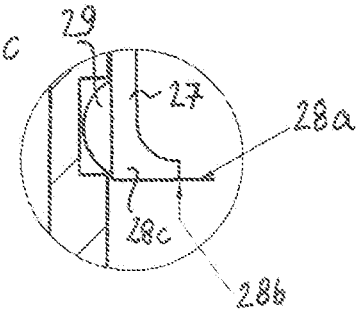
FIG. 2*c* shows a first modified type of closure cap of the second embodiment in the enlarged section.
Figure 2B:
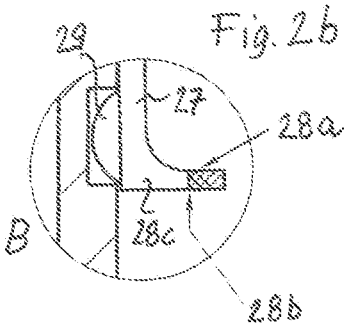
FIG. 2*b* shows an enlarged detail B of FIG. 2*a;*

As can be seen in FIG. 2*c*, the middle portion 27 extends, in the cross-section shown, no longer perpendicular to the lip portion 28 (as in FIG. 1), but instead describes a radius of curvature which is formed because the expansion portions are formed as folds or material bulges in the middle portion 27. For the functioning of the outermost end of the lip portion 28 as a tamper-evident sealing element 28*a*, it is sufficient if at least the seal ring 28*a* has no expansion portions and, only upon removal of the seal ring 28*a* along the perforation 28*b*, the expansion grooves in the middle portion 27 and the remaining lip portion 28*c* reach up to the outermost edge of the cover 20. Then (and only then) can the cap 20 in the concave bistable state of FIG. 2*c* expand in its edge portion 22 so that the cap 20 can be removed from the opening 1. The remaining lip portion 28*c* may be useful when the cover 20 is not to be used as a cap but as a lid, as shown and explained in more detail in FIGS. 4 and 5.

Figure 2D:
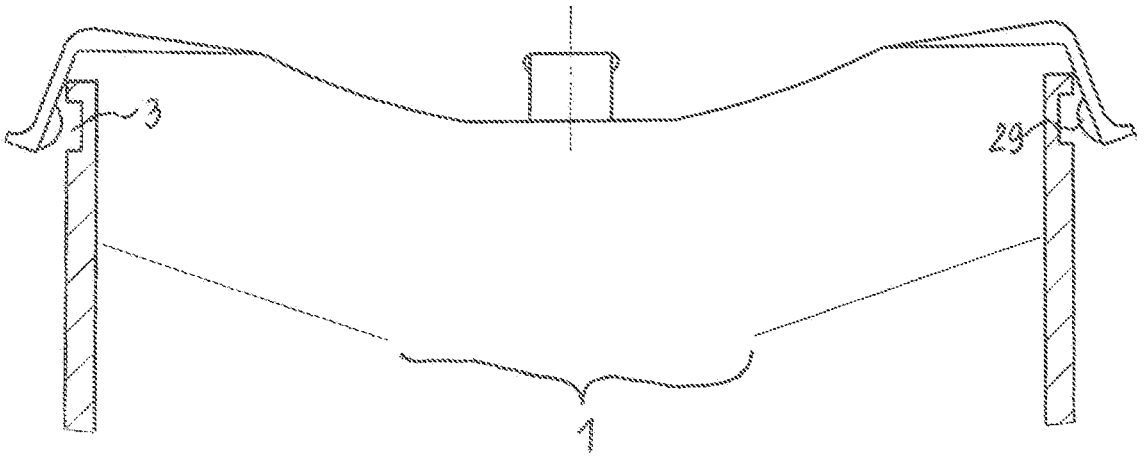
FIG. 2*d* shows the closure system according to FIG. 2*a* in the open position.

In the FIG. 2*c*, the same principle is shown, although here the material thickness of the seal ring 28*a* may be greater than that of the front wall 21 for reasons of manufacturing technology and is also depicted in the Figure like that. FIG. 2*d* shows (analogously to FIG. 1*c*) the cap 20 in the open position with the seal ring 28*a* removed.

Figure 3A:
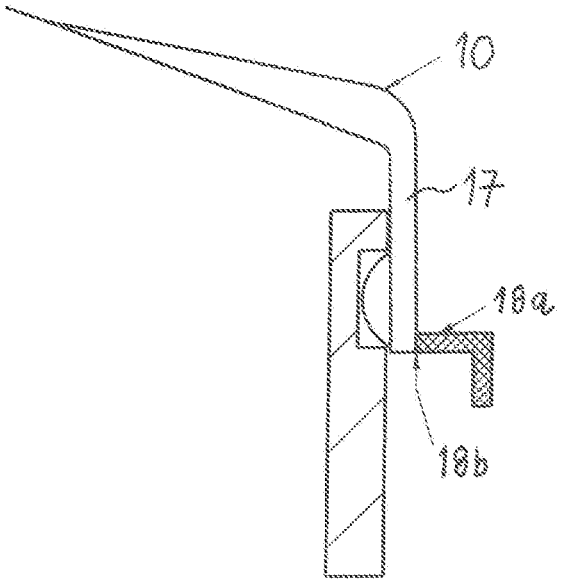
FIG. 3*a* is a partial cross-sectional view of another closure system with a second modified type of closure cap of the first embodiment.
Figure 3B:
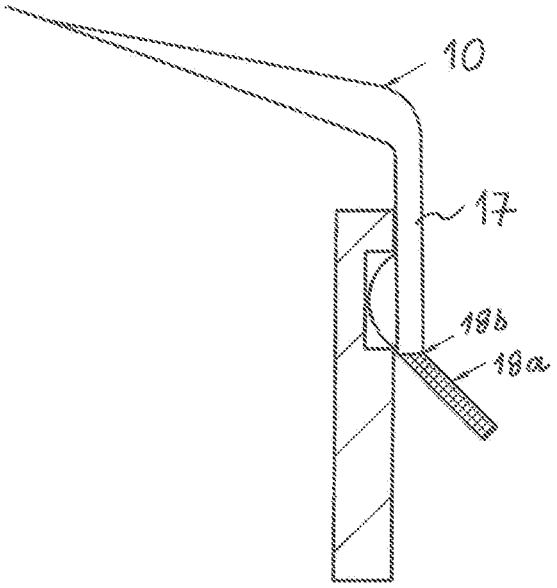
FIG. 3*b* is a partial cross-sectional view of another closure system with a third modified type of closure cap according to the first embodiment.

FIGS. 3*a* and 3*b* show two preferred variants of the first embodiment of the cap 10, which relate to simplifications in the manufacturing technology. In the variant according to FIG. 3*a*, the seal ring 18*a* extends in a downwardly bent form. Such an angled portion can be produced particularly well in thermoforming technology and (like the original variant according to FIG. 1) has the advantage that the perforation 18*b* between seal ring 18*a* and middle portion 17 can be made from the top by a punching tool after the deep-drawing process.

In the variant according to FIG. 3*b*, the seal ring 18*a* extends at an angle of approximately 45° inclined to the middle portion 17 which extends in the direction of attachment. Here, one can produce the perforation 18*b* between the middle portion 17 and the seal ring 18*a* by using a punching tool which surrounds the cap 10 from the side. Such punching operations are common and easy to use, especially when manufacturing the cap by injection molding.

Figure 4A:
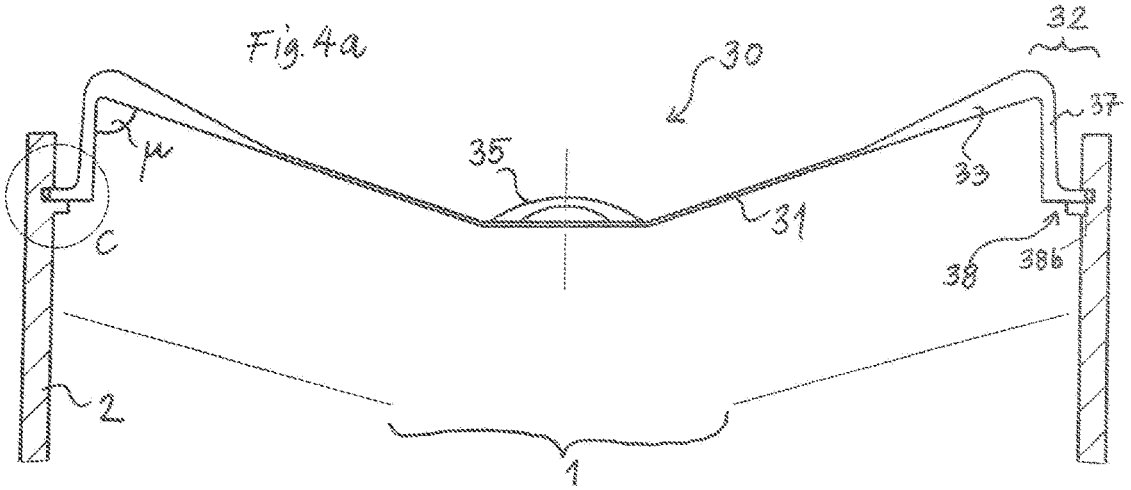
FIG. 4*a* is a cross-sectional view of a closure system according to the present invention with a closure lid according to a third embodiment in the closed position.
Figure 4B:
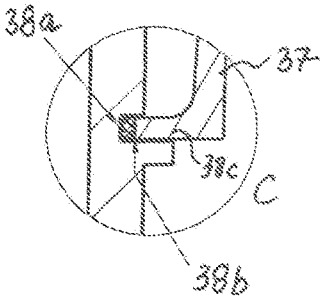
FIG. 4*b* shows an enlarged detail C of FIG. 4*a;*

FIG. 4*a* shows the third embodiment in which the cover is no longer designed as a cap which clamps from the outside, but as a lid 30 which is seated inside in the opening wall 2. Unlike the cap, the concave bistable state with the larger outer diameter is then the closed state, while the convex bistable state with the smaller outer diameter is the opened state. In addition, the transition angle μ between the front wall 31 and the edge portion 32 is here no longer larger but smaller than 90°. Otherwise, the function of the front wall 31, the edge portion 32, the reinforcement region 33, the middle portion 37 and the lip portion 38 with the perforation 38*b* and the seal ring 38*a* is exactly as in the second embodiment of FIG. 2 and will therefore not be discussed here.

Unlike the two previously described embodiments, the wall region 2 of the container opening 1 has no outer peripheral groove, but an inner groove 4, which ends in an inwardly projecting shoulder 5, which is intended to prevent the cover 30 from falling into the opening 1. In addition, the handle member 35 is no longer designed as a gripping dome, but as a bow handle. Depending on the production technique and the desired requirements for the handle member, it is possible to freely choose between the different handle shapes.

Figure 4C:
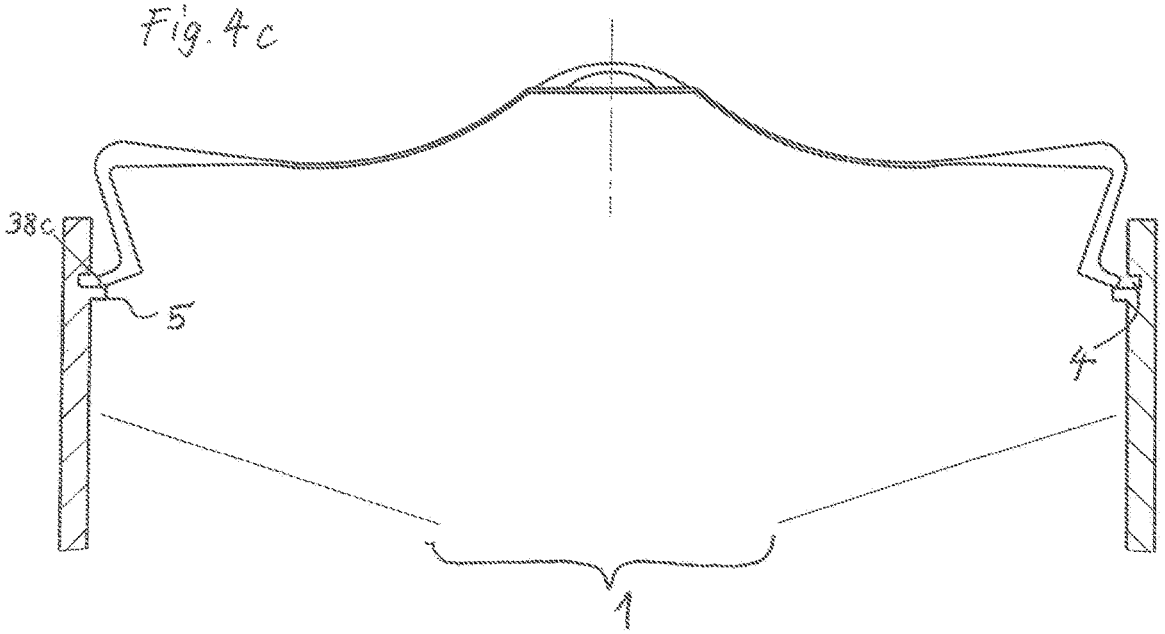
FIG. 4*c* shows the closure system according to FIG. 4*a* in the open position.

As can be seen particularly well in FIG. 4*c*, the lip portion 38*c* remaining after tearing off the seal ring 38*a* along the perforation 38*b* can spread into the inner groove 4 and thus ensure a secure seating of the lid 30 on the opening 1 to be closed. In addition, the handle 35 is, in the closed position shown in FIG. 4*a*, located such far within the opening 1 that accidental opening by an impact onto the handle 35 is very unlikely.

FIG. 5 shows a fourth embodiment of the invention, wherein the cover 40 has a significantly flatter shape than in the previously described embodiments. The transition angle μ between the front wall 41 and the edge portion 42 is here no longer in the vicinity of 90° but approximately 160° to 170°. However, the function of the front wall 41, the edge portion 42, the reinforcement region 43 and the handle member 35 is the same as in the third embodiment of FIG. 4 and will therefore not be explained in detail here.

FIG. 5 explains, with reference to two illustrative examples, how the seal ring 38*a* shown only schematically in FIG. 4 can be removed. For this purpose, two modifications are illustrated in FIG. 5 in a single schematic representation. On the left side of FIG. 5*a*, the seal ring 48*a* terminates in a lug 48A protruding from the inner groove 4, by means of which it can be gripped from above and removed along the perforation 48*b*. This variant is based essentially on the basic principle illustrated in FIG. 4 and differs therefrom only in the length and the spatial orientation of the seal ring 48*a*. On the other hand, a further variant is shown on the right side of FIG. 5*a*, which differs fundamentally from the previously shown variants and embodiments and will be explained in more detail below.

Figure 5A:
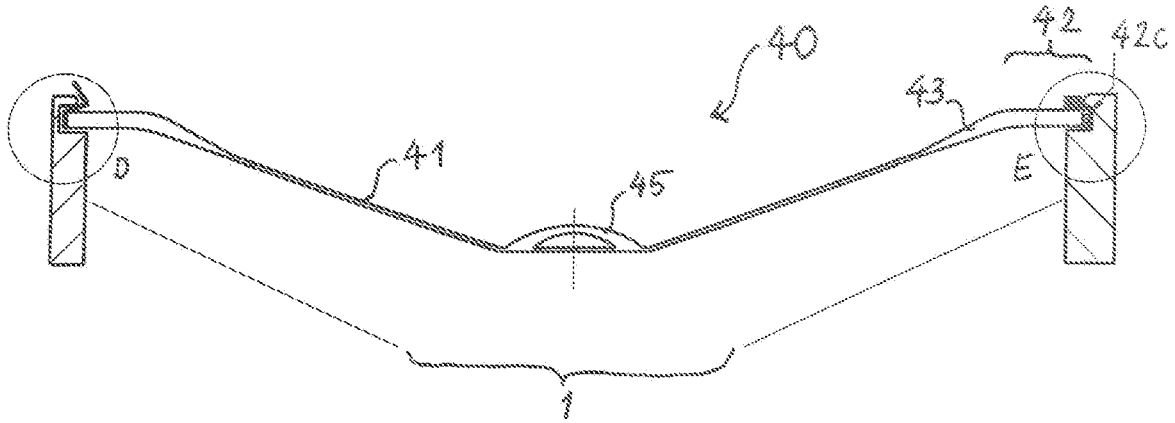
FIG. 5*a* is a cross-sectional view of a closure system according to the present invention with a closure lid, in which a fourth and a fifth embodiment are shown as alternative variants, in the closed position.
Figure 5B:
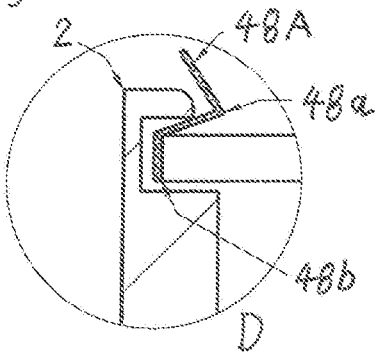
FIG. 5*b* shows an enlarged detail D of FIG. 5*a;*

The enlarged detail D of FIG. 5*b* shows that the seal ring 48*a* is integrally formed essentially at the radially outermost edge of the cover 40 as in FIG. 4 and is formed, for example, during assembly of the cover 40 on the container, by a bent projection in the form of a gripping lug 48A which extends so far out of the container that it can be easily separated at the perforation 48*b* from the edge portion 42 to remove the seal ring 48*a*. Only then can the expansion grooves formed in the edge portion 42 (not shown in the section shown here—but see FIG. 9) expand or contract when snapping between the two bistable states of the front wall 41.

Figure 5C:
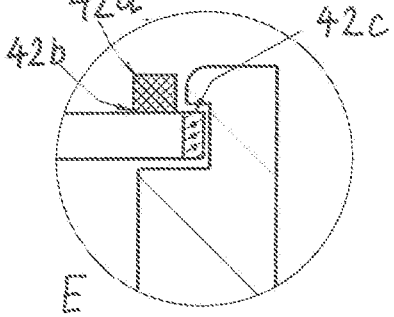
FIG. 5*c* shows an enlarged detail E of FIG. 5*a;*

In the variant shown in FIG. 5*c*, the seal ring 42*a* no longer sits at the outermost radial end of the edge portion 42, but above it, and thus extends upwards from the edge portion 42 against the direction of attachment. At this position, the seal ring 42*a* can be molded on the cover 40, for example in an injection molding process. At this position, the seal ring 42*a* can also prevent a widening of the expansion portions in the edge portion 22, because it connects the regions between two expansion portions and due to its material properties (in multi-component injection molding: the harder material) it does not allow the expansion of the material at the expansion portions or at least not to the extent required.

Figure 5D:
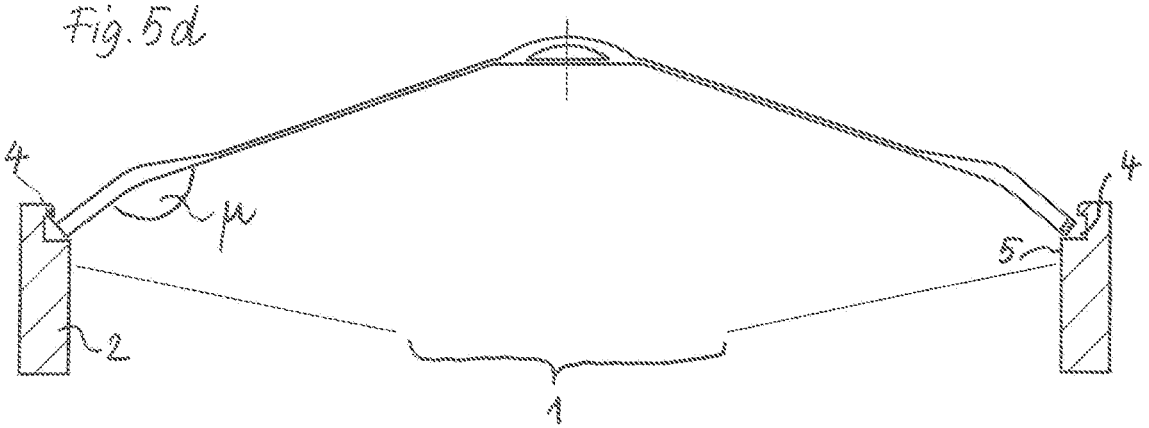
FIG. 5*d* shows the closure system according to FIG. 5*a* in the open position.

Only after the seal ring 42*a* has been removed from the perforation 42*b* or predetermined breaking point provided for this purpose, this restriction is eliminated and the cover 40 can snap over into the open position shown in FIG. 5*d*. In addition, in the variant according to FIG. 5*c*, a rubber seal or gasket 42*c* can be attached to the outermost outer circumference of the edge portion 22, which allows a sealing closure of the opening 1 due to its tight fit in the inner groove 4.

The embodiment of the lid 40 according to FIG. 5 differs in particular from the embodiments described above by the particularly large angle μ in the transition region between the front wall 41 and the edge portion 42. As a result, the cover 40 has an attractive outer shape, and a particularly effective enlargement of the outer diameter can be caused when snapping between the two bistable states.

FIG. 6 is intended to illustrate possibilities in which the seal ring 48*a* according to the invention can be pulled off the container when the cover is opened for the first time. For this purpose, two modifications of the embodiment shown in FIG. 5*b* are shown.

Figure 6A:
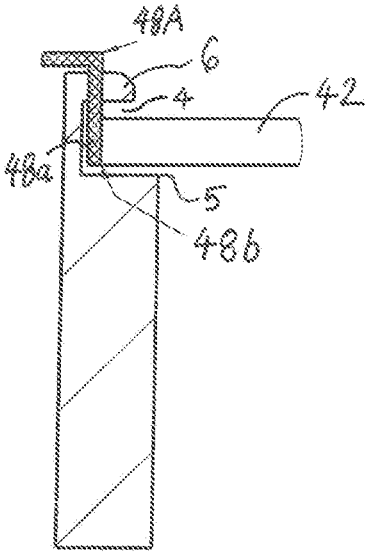
FIG. 6*a* is a partial cross-sectional view of a closure system according to the invention with a variant of the fourth embodiment in a closed position.
Figure 6C:
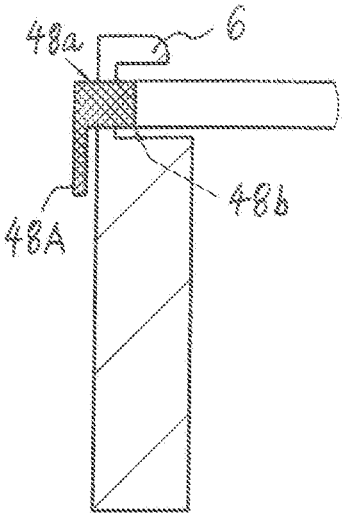
FIG. 6*c* shows a cross-sectional partial view of a closure system according to the invention with a further variant of the fourth embodiment in the closed position.
Figure 6B:
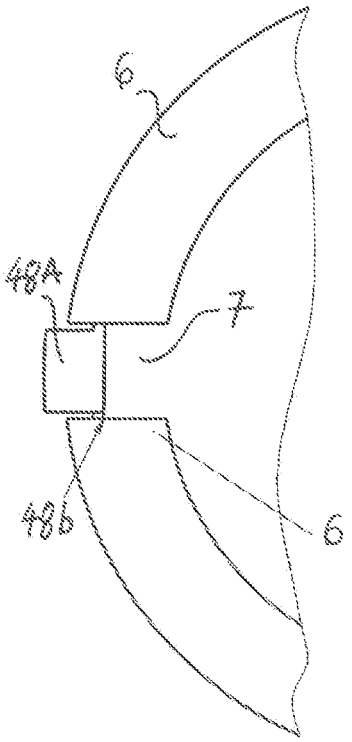
FIG. 6*b* is a plan view of the partial view of FIG. 6*a;*
Figure 6D:
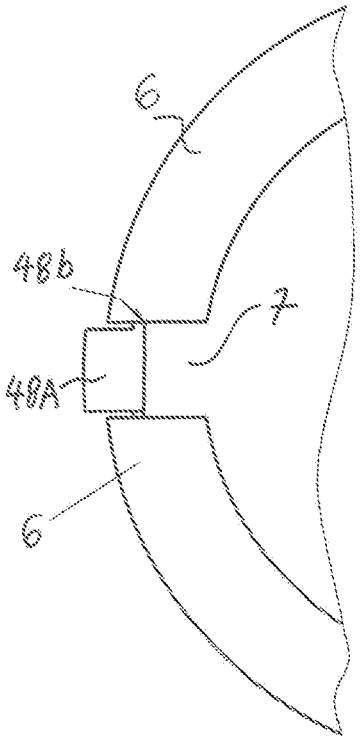
FIG. 6*d* is a plan view of the partial view of FIG. 6*c;*

In FIG. 6*b*, it can be seen that the upper edge 6 of the container opening 1 to be closed has a recess 7, through which the seal ring 48*a*, as shown in FIG. 6*a*, can be easily gripped on its lug 48A from above. But it can just as well be provided as a seal ring 48*a* protruding downwardly from the recess, as shown in FIGS. 6*c* and 6*d*.

The seal ring 48*a* can in both cases be removed from the cover by being grasped by the lug 48A by hand and removed by pulling it to the right in the drawing along its perforation 48*b*. Equally, it is also possible to hold the seal ring 48*a* at its lug 48A while rotating the container so that the seal ring 48*a* detaches from the lid along the peripheral perforation 48*b*.

Figure 7A:
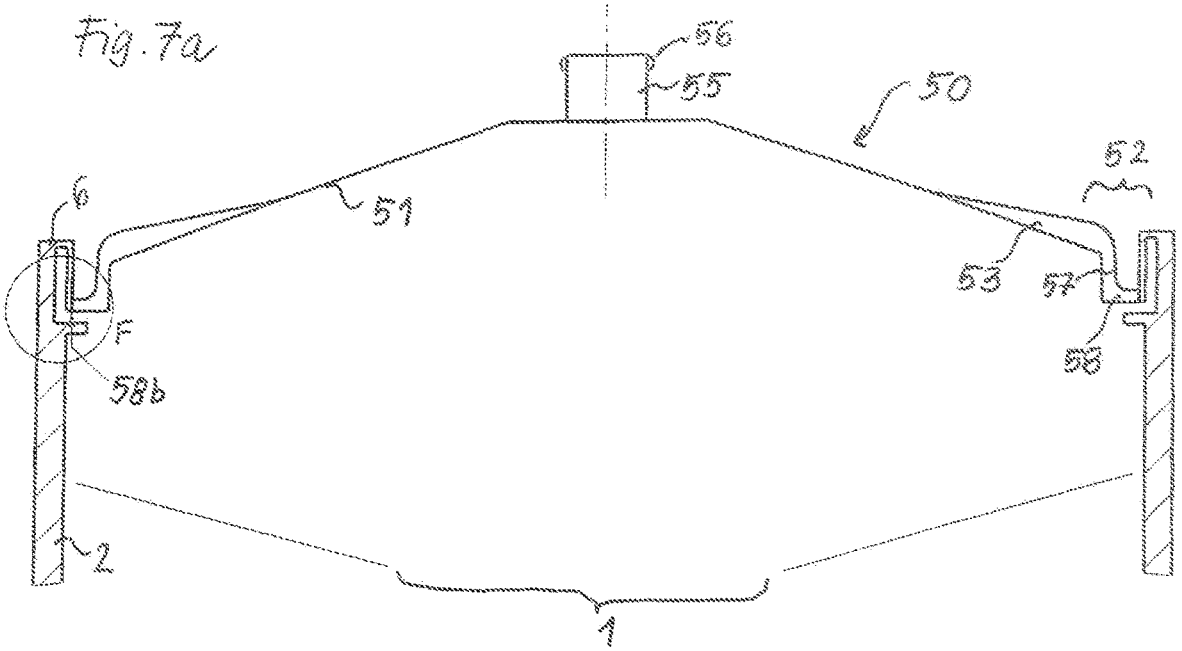
FIG. 7*a* is a cross-sectional view of a closure system according to the present invention with a closure cap according to a sixth embodiment in the closed position.

FIG. 7*a* shows a closure system according to a fifth embodiment of the invention. Here, the seal ring 58*a* is not only formed at the outermost peripheral edge of the edge portion 52 (as part of its lip portion 58) but also connected to the uppermost peripheral edge 6 of the container wall 2. The perforation 58*b* is then located at the point of the lip portion 58 where the expansion portions (not shown—see FIG. 10) terminate.

Figure 7B:
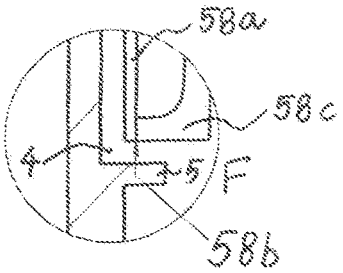
FIG. 7*b* shows an enlarged detail F of FIG. 7*a;*

As shown in FIG. 7*b*, an air gap should remain between the shoulder 5 and the lip portion 58, so that the cover 50 can be pushed slightly forwards to detach the seal ring 58*a*. After the perforation 58*b* has been broken, the seal ring 58*a* preferably remains on the wall section 2. Then, the remaining lip portion 58*c* of the lid 50 can sealingly engage into the gap serving as the inner groove 4 between the seal ring 58*a* and the shoulder 5 when it is brought to the closed position (not shown).

The function and design of the front wall 51, the edge portion 52, the reinforcement region 53, the gripping dome 55 and the gripping knobs 56 are the same as in the second embodiment shown in FIG. 2 and will not be explained again here.

Figure 8A:
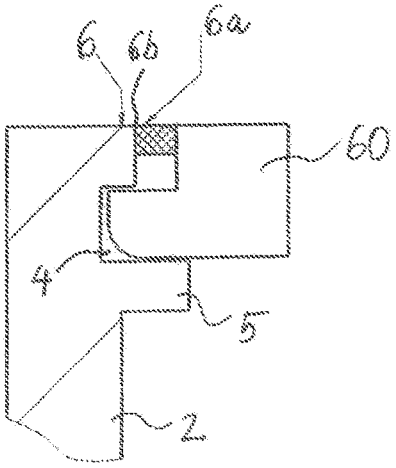
FIG. 8*a* shows a partial cross-sectional view of a closure system according to a seventh embodiment of the present invention in the closed position.

FIG. 8 also schematically shows the possibility of attaching the seal ring only to a section of the peripheral edge 6 of the container wall 2. According to this seventh embodiment, the seal ring 6*a* forms, as shown in FIG. 8*a*, an extension projecting inward from the inner circumference of the peripheral edge 6, which can be detached from the wall section 2 of the container opening 1 along the perforation 6*b*. The lid 60 then no longer has its own seal ring.

Figure 8B:
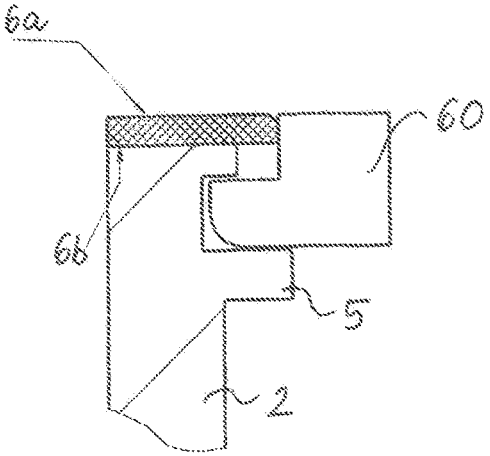
FIG. 8*b* is a partial cross-sectional view of a closure system according to a variant of the seventh embodiment in the closed position.

In the variant of the seventh embodiment shown in FIG. 8*b*, the annular seal ring 6*a* is formed so as to form the complete upper peripheral end of the container wall 2. In both cases, the seal ring 6*a* locks the vertical movement of the lid's edge portion required for the lid 60 to flip over and thus prevents the lid 60 from being brought into its open position when the seal ring 6*a* is intact.

In FIGS. 9 and 10, the basic principle of a snap-fit cover will now be explained in two example variants. Both variants shown represent the cover 70, 80 with already removed seal ring.

Figure 9A:
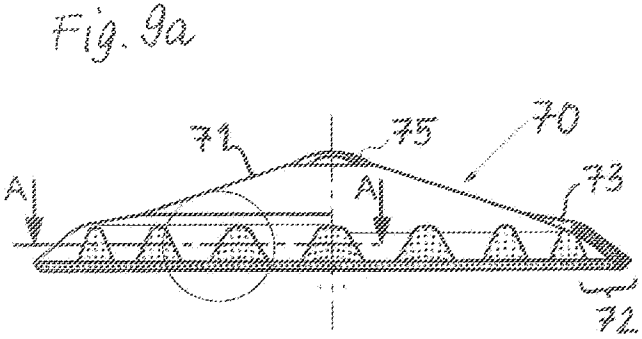
FIG. 9*a* shows a side view, partially in cross section, of a closure lid produced using multi-component injection molding technology after removal of the sealing element.
Figure 9B:
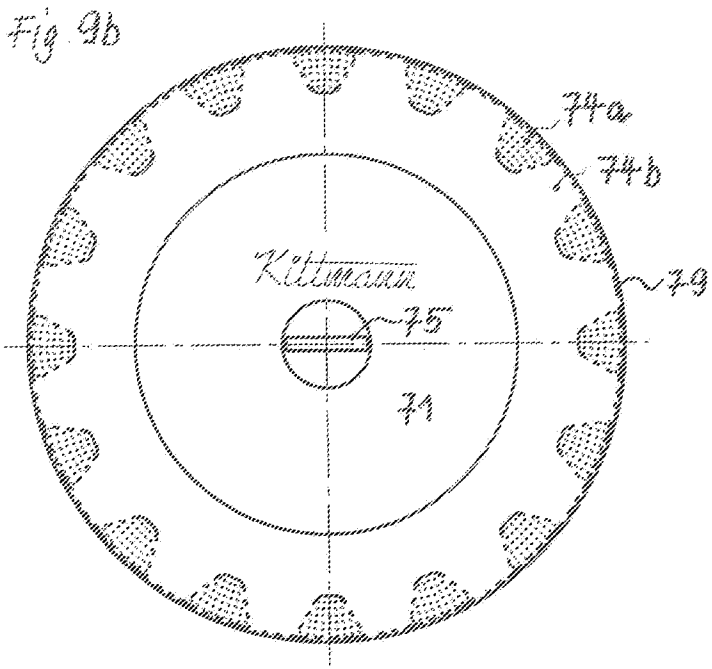
FIG. 9*b* is a plan view of the lid of FIG. 9*a;*

The lid 70 shown in FIGS. 9*a* and 9*b* has a front wall 71 of a substantially circular basic shape, on the peripheral edge of which an annular edge portion 72 is formed. FIG. 9*a* shows a side view partially in section. In the left half of the Figure, the lid 70 is seen from the side, while in the right half it is cut inside, so as to show the rear inside of the lid 70.

The lid 70 is shown in its open position, i.e. the front wall 71 is, as seen in FIG. 7*a*, in its convex, upwardly cambered bistable state. If the front wall 71 snaps into its concave downward state (i.e. in the direction of attachment), the outer circumference of the edge portion 72 increases, so that a radial end of the edge portion 72 can engage with an inner groove 4 in the wall region 2 of the opening 1 to be closed.

In order to keep the angle μ constant, which the front wall 71 and the edge portion 72 include in their transition region, the lid material should have sufficient rigidity. This is achieved according to the invention in that the transition between the front wall 71 and the edge portion 72 has, at least in sections, but preferably over the entire circumference, a higher material thickness than the central region of the front wall 71.

The enlargement of the outer periphery in the concave bistable state (not shown) from the convex state shown in FIG. 9*a* requires sufficient stretching flexibility of the peripheral edge portion 72. This is achieved according to the invention by circumferentially (preferably equidistantly) arranged expansion portions 74*a* of the softer second material component, which alternate with intermediate sections 74*b* of the harder first material component. As shown in FIG. 9*b*, the expansion portions 74*a* start at the transition region between the front wall 71 and the edge portion 72 and widen towards the radial outer edge.

The edge portion 72 terminates in both its expansion portions 74*a* and in its intermediate portions 74*b* in a circumferential latching ring 79, which is also formed of a softer material component, preferably the same as the expansion portions 74*a*. This circumferential latching ring 79 gives the thin-walled lid 70 not only additional dimensional stability, but is also sufficiently elastic to allow the enlargement of the outer periphery in the concave snapping position.

Finally, the cover 70 further has a handle member 75 centrally formed on its front wall 71 in the form of a handle or bracket. This can be taken by hand or with a hook or the like safely and reliably to put the lid 70 on the opening to be closed 1 and to withdraw it again therefrom without lateral tilting.

As a manufacturing method for the lid 70, the already mentioned multi-component injection molding of one or more thermoplastics is particularly well suited. By the multi-component technique, a first (base) component can be injected for forming the front wall 71 and the intermediate portions 74*b*, while the expansion portions 74*a* as well as the latching ring 79 are molded directly from a softer second component in a single manufacturing process. An optional third (particularly hard) material component for forming the transition region between front wall 71 and the edge portion 72 can also be molded directly in a single multi-component injection molding.

Figure 10A:
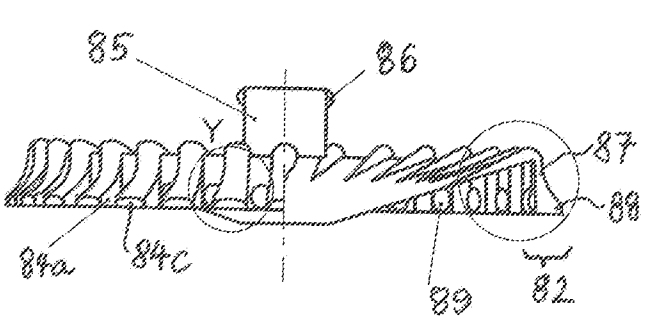
FIG. 10*a* is a side view, partly in cross section, of a thermoformed closure cap thermoformed after removal of the sealing element.
Figure 10B:
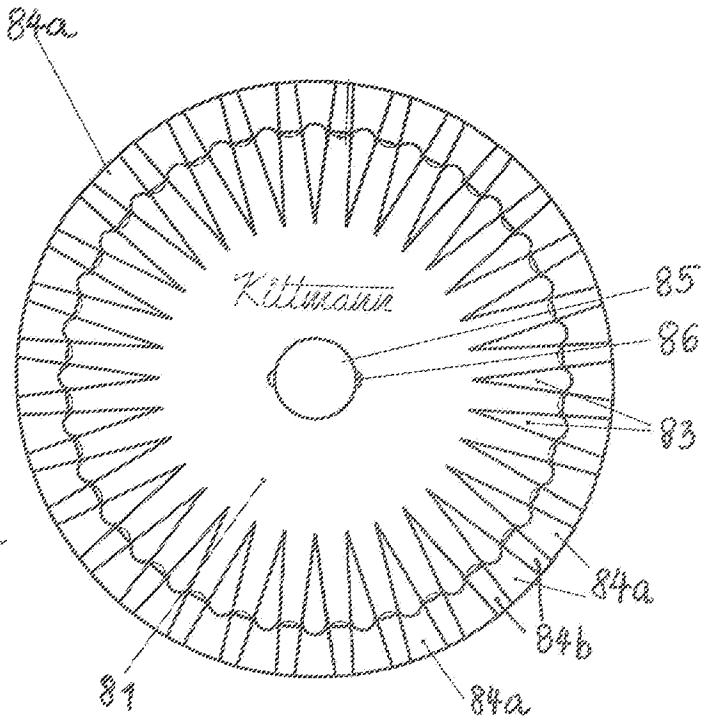
FIG. 10*b* is a plan view of the cap of FIG. 10*a;*

The closure cap 80 shown in FIGS. 10*a* and 10*b* can be produced by a thermoforming process in a particularly material-saving and cost-effective manner. The cap 80 has a front wall 81 of substantially circular basic shape, on whose peripheral edge an annular edge portion 82 is integrally formed. The edge portion has a substantially axial, i.e. along the direction of attachment, extending middle portion 87 and a lip portion 88 extending transversal thereto, i.e. in the radial direction. On the middle portion 87, preferably radially inwardly projecting latching knobs 89 are formed, which are designed for a clamping engagement into an opening outer wall (in particular into an annular groove provided therein).

The cap 80 is shown in its open position, i.e. the front wall 81 is in its bistable state cambered downwards (i.e. in the direction of attachment), as shown in FIG. 10*a*. When the front wall 81 snaps into its convex, upwardly cambered state, the inner and outer circumference of the edge portion 82 decreases so that the latching knobs 89 engage with the wall region of the opening to be closed.

It is crucial for the functioning of the snap-fit mechanism, that the angle μ, included by the front wall 81 and the edge portion 82 in their transition region, is kept constant for both bistable states. For this, the cap material should have sufficient rigidity. According to the invention, this is achieved in the case of the covers 80 which are produced by the thermoforming process and have a substantially homogeneous wall thickness, in that reinforcement ribs 83 are provided in the transition region between the front wall 81 and the edge portion 82. These reinforcement ribs 83 extend radially outwards from the radially outer region of the front wall 81 and extend into the middle portion 87 of the edge region 82. They thus provide an elevation or deepening transverse to the material plane which creates, according to the principle of a corrugation, a stiffening of the cover 80 in the range of the angle μ.

The enlargement of the outer circumference in the shown concave bistable state in relation to the convex state (not shown) also requires sufficient expansion flexibility of the peripheral edge portion 82. This is achieved according to the invention by circumferentially (preferably equidistantly) arranged expansion grooves 84*a*, which start from the upper edge of the middle portion 87 adjacent to the front wall 81 and extend from there obliquely outward to the radially outer edge of the lip portion 88, while the middle portion 87 in the remaining area 84*b* away from the expansion grooves 84*a* extends axially, i.e. along the direction of attachment, downwards and from there substantially perpendicular to the lip portion 88.

The so created folds of the edge portion 82 create expansion grooves 84*a*, which resemble web skins in their construction and enable a desired enlargement of the outer circumference or diameter of the cover 80 between the two bistable states. Care must be taken that the folds reach to the outermost edge, i.e. that the expansion grooves 84*a* on the outer circumference of the lip portion 88 form radial openings 84*c*. With these approximately semi-circular openings 84*c*, the edge portion 82 can actually "unfold" in the downward cambered state and enlarge its outer circumference relative to the convexly upward cambered state.

In the following, further embodiments of the present invention will be explained with reference to FIGS. 11 to 15. Most of the previous explanation applies analogously to the now following embodiments, so that only the respective differences will be explained to avoid unnecessary repetitions. Combinations of the elements of the invention described for the individual embodiments are also possible and encompassed by the present description.

Figure 11A:
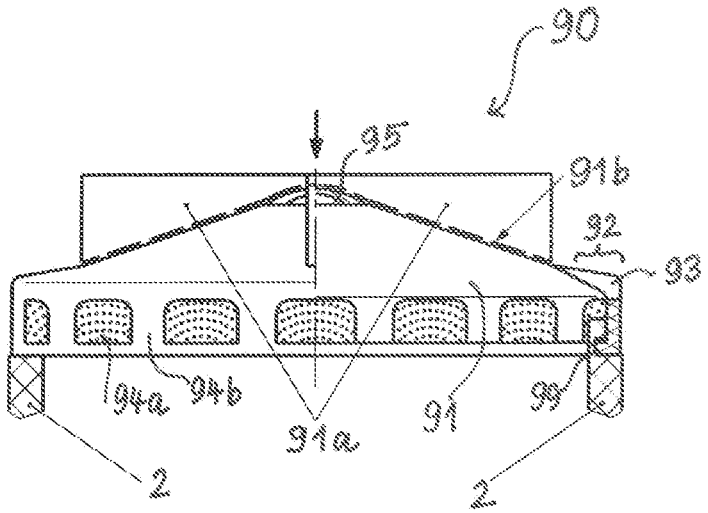
FIG. 11*a* is a partially sectioned side view of a closure system with a closure cap according to an eighth embodiment of the present invention in the closed position.
Figure 11B:
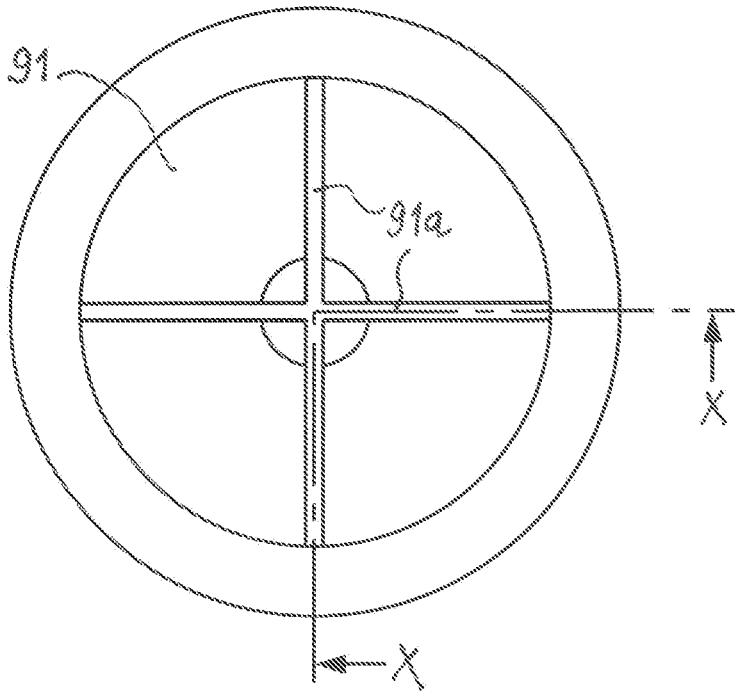
FIG. 11*b* is a plan view of the cap of FIG. 11*a;*

FIG. 11*a* shows the eighth embodiment of the present invention in a partially sectioned side view. FIG. 11*b* shows the associated plan view and a line X-X, along which the section on the right half of the Figure has been made, leading to the sectional view shown in FIG. 11*a*.

The cap 90 is similar in construction to the cap 10 of FIG. 1. The correspondences reside essentially in that the cap 90 as well as the cap 10 is externally clamped to the wall 2 of an opening to be closed 1 by radially inwardly projecting protrusions 99 of the edge section 92 which engage externally into a groove of the wall 2. In addition, the cap 90 has the reinforcement regions 93 and the expansion portions 94*a* separated by intermediate sections 94*b*, which in the manner already explained in more detail make it possible for the front wall 91 to flip over between the two bistable states for opening the cap 90. Similar to the embodiments already explained, the cap 90 has a handle member 95, designed here as a bow-shaped handle, for gripping and opening the cap 90.

Unlike in all embodiments explained above, the tamper-evident seal in the embodiment 8 is not realized indirectly by preventing a change in the outer circumference of the cap 90 in the originality state. Instead, the front wall 91 should be directly prevented from snapping into the second bistable state. This is achieved according to the invention by means of the central webs 91*a* formed as a sealing element on the front wall 91, which stiffen the front wall 91 in the manner of a rib and thereby act as a mechanical barrier against elastic deformation of the cap 90 in and against the direction of attachment. The connecting region between the webs 91*a* and the front wall 91 is perforated and this perforation 91*b* acts as a predetermined breaking point in order to easily remove the webs as the tamper-evident sealing element 91*a* when the cap 90 is opened for the first time.

In the embodiment shown, four webs 91*a* form a right-angled cross. But their number can also be higher or smaller and even only a single such web 91*a* may be present as long as a deformation of the front wall 91 is thereby prevented in the originality state. Also, the webs 91*a* need not necessarily be positioned in equidistant intervals and the attachment line between the webs 91*a* and the front wall 91 also does not (as shown) need to extend radially and continuously. In particular, the central webs 91*a* can also be attached to the opening wall 2 and be detached therefrom by a predetermined breaking point when opening for the first time.

Figure 12A:
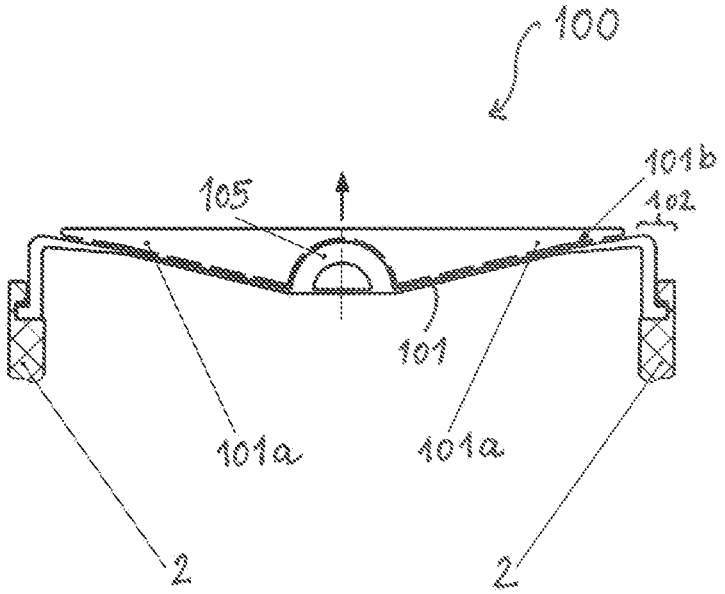
FIG. 12*a* is a sectional side view of a closure system with a closure lid according to a ninth embodiment of the present invention in the closed position.
Figure 12B:
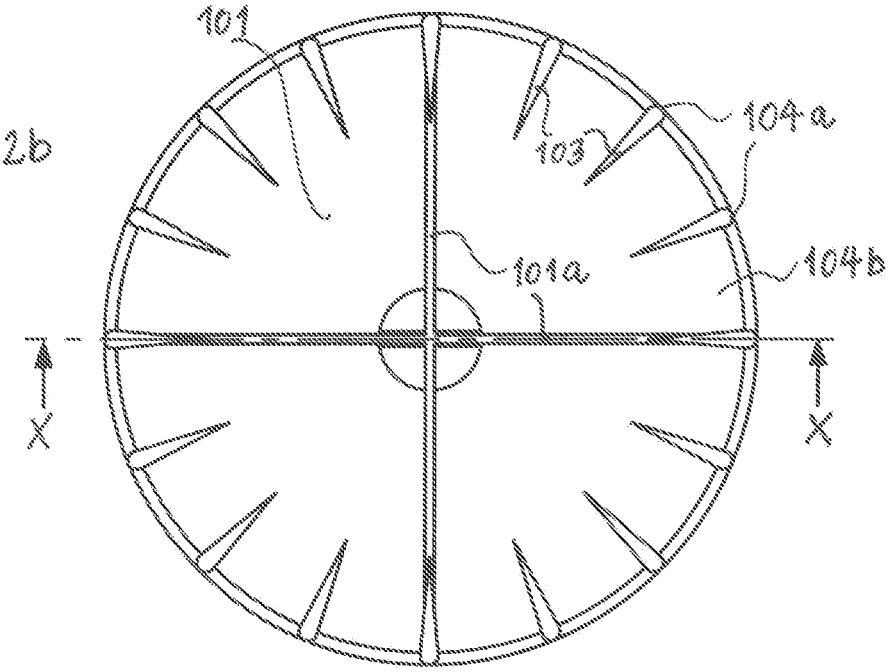
FIG. 12*b* is a plan view of the lid of FIG. 12*a;*

The ninth embodiment of the present invention is shown in FIGS. 12*a* and 12*b*. FIG. 12*b* shows a plan view of the cover 100 and a line X-X, along which the cut has been made, leading to the sectional view of the cover 100 shown in FIG. 12*a*.

Analogous to the cap 90 of FIGS. 11*a* and 11*b*, in the case of the cover 100 according to embodiment 9, the front wall 101 is mechanically blocked by rib-like transverse webs 101*a* which are connected to the front wall 101 at a perforation line 101*b*. The function and construction of the edge portion 102, the reinforcing ribs 103 and the expansion and intermediate portions 104*a*, 104*b* essentially correspond to the structure of the corresponding elements of the third embodiment shown in FIGS. 4*a-c*. The main difference between embodiments 8 and 9 is therefore only that the FIG. 11 shows a cap 90 clamped outside on the opening wall 2, while in FIG. 12 it is a cover 100 seated inside in a groove of the opening wall 2.

Figure 13A:
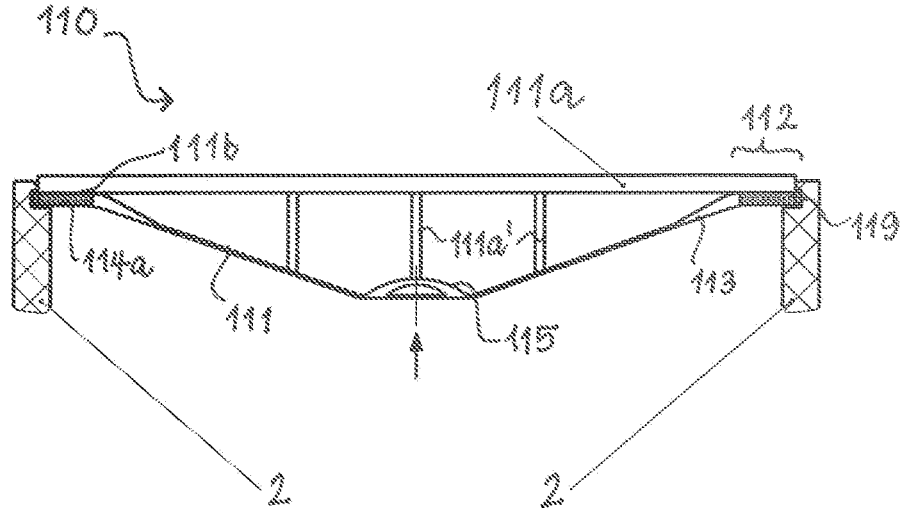
FIG. 13*a* is a sectional side view of a closure system with a closure lid according to a tenth embodiment of the present invention in the closed position.
Figure 13B:
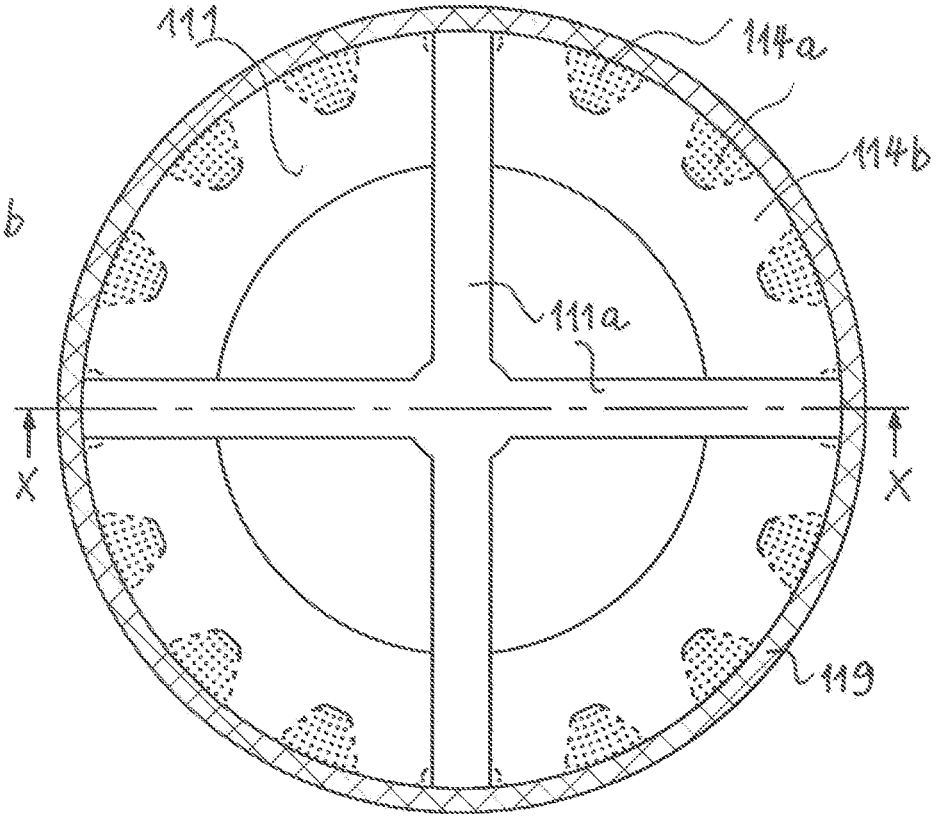
FIG. 13*b* is a plan view of the lid of FIG. 13*a;*

The tenth embodiment shown in FIGS. 13*a* and 13*b*, just like the two last-mentioned embodiments 8 and 9, uses mechanical blocking of the front wall 101 in the closed position. FIG. 13*b* shows a plan view of the cover 110 and a line X-X along which the section has been made, leading to the sectional view of the cover 110 shown in FIG. 13*a*. The basic structure of the relatively flat cover 110 with the edge portion 112, the reinforcement ribs 113, the expansion portions 114*a*, the intermediate portions 114*b* and the projection or latching ring 119 substantially corresponds to the construction of the fifth embodiment shown in FIG. 5.

Unlike in the fifth embodiment, however, the tamper-evident security is not effected here by a size-fixing of the outer circumference, but also by a direct mechanical blocking of the front wall 111 in its closed bistable state. This is again achieved by four webs 111*a*, which are integrally formed with the cover 110 and linked thereto via a perforation 111*b* as a predetermined breaking point. Unlike the embodiments 8 and 9, the webs 111*a* are, however, attached to the edge portion 112 of the lid 110 and do not flush with the front wall 111 in the direction of attachment downwards. Instead, they have only one flat base member and at least one spacer 111*a*' axially extending from the base member in the direction of attachment, which prevents a reduction of the distance between the front wall 111 and the horizontally extending part of the reinforcement element 111*a*. The tenth embodiment also works just as well in variants in which the web 111*a* in the direction of attachment extends flat, as it is the case in the embodiments 8 and 9. In addition, the invention is not limited to the number of webs, the spacers, their radial orientation, etc. Also, the perforation 111*b* is not necessarily positioned on the edge portion 112 and may instead be provided, for example, at the opening wall or at the connection point between the spacers 111*a*' and the front wall 111.

Figure 14A:
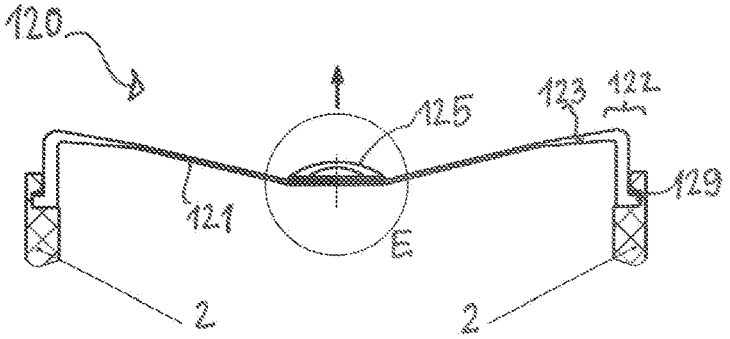
FIG. 14*a* shows a sectional side view of a closure system with a closure lid according to an eleventh embodiment of the present invention in the closed position but with the tamper-evident seal removed.
Figure 14B:
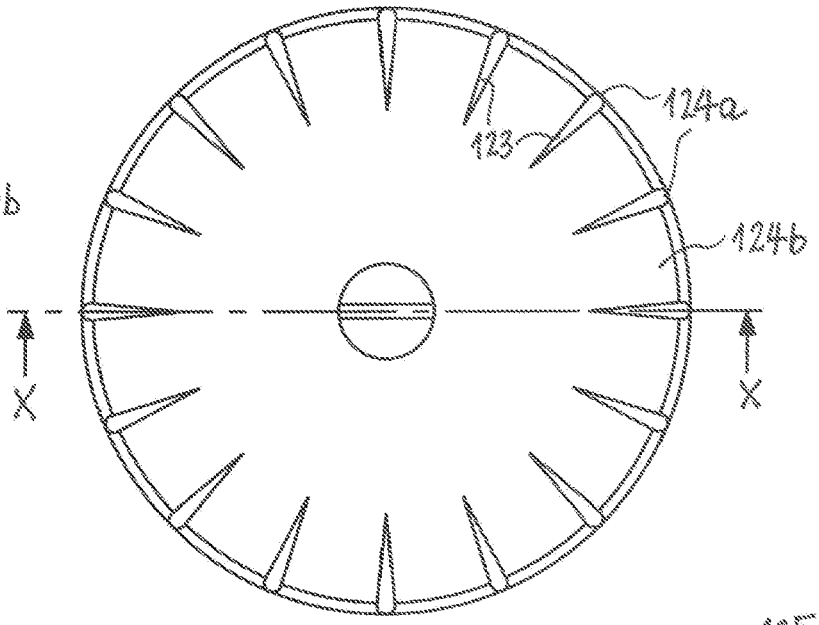
FIG. 14*b* is a plan view of the lid of FIG. 14*a;*

FIG. 14*a* shows a lid 120 with a tamper-evident sealing element according to an eleventh embodiment of the invention. FIG. 14*b* shows a plan view of the lid 120 and a line X-X, along which the cut was made, which leads to the sectional view of the lid 120 shown in FIG. 14*a*. The lid 120 with the front wall 121, the edge portion 122, the reinforcement ribs 123 and the expansion and intermediate portions 124*a*, 124*b* and the projection or latching ring 129 corresponds in its basic structure to the lid 100 of FIG. 12*a* and the lid 30 of FIG. 4*a*. These basic elements are therefore not explained here again.

Unlike the embodiments described so far, it is possible to produce the tamper-evident safety means of the cover 120 in the eleventh embodiment by means of a special design of the handle member 125. In the positions shown in FIGS. 14*a-d*, the handle member 125 is shown in its normal operating position after removal of the tamper-evident seal. By pulling upwards (see arrow in FIG. 14*a*), the bow handle 125 triggers a bistable snapping of the front wall 121, which causes a reduction of the outer lid circumference and thus enables a lifting of the lid 120 from the opening.

Figure 14E:
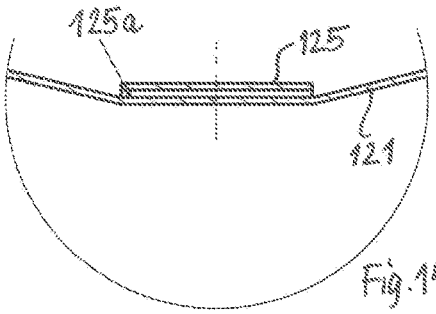
FIG. 14*e* the enlarged detail E in a side view in section before removal of the tamper-evident seal.
Figure 14C:
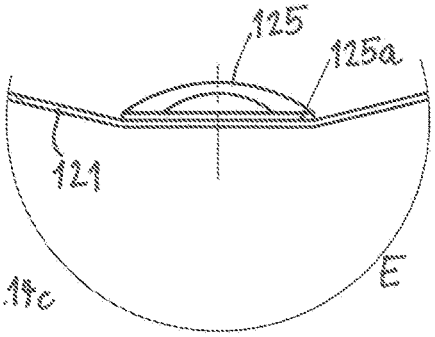
FIG. 14*c* shows an enlarged detail E of FIG. 14*a;*
Figure 14F:
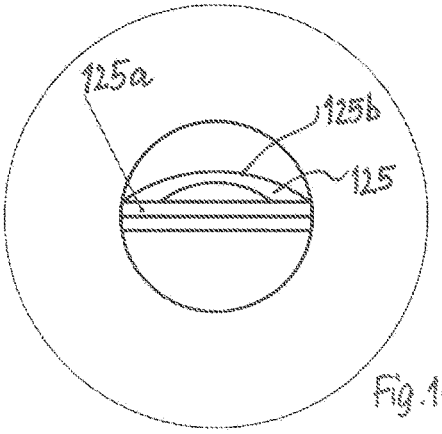
FIG. 14*f* shows the enlarged detail E in plan view before removal of the tamper-evident seal.
Figure 14D:
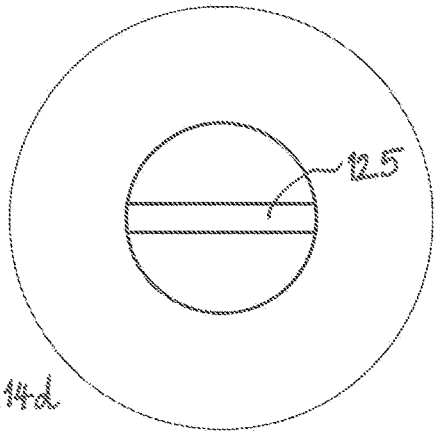
FIG. 14*d* shows the enlarged detail E in plan view.

However, prior to the first opening, the handle member 125 is in the original condition shown in FIGS. 14*e* and 14*f*. In this, the bracket of the handle member 125 is folded around the film hinge 125*a* to the rear and is along a perforation line 125*b* connected to the front wall 121 or otherwise glued or selectively welded so that it rests flush on the front wall 121. In this closed original position, the user cannot grasp the front wall 121 at any point suitable for pulling it up to let the front wall 121 snap into its open state. Only by loosening the bracket element along the perforation line 125*b* or separating the bond or weld the user may fold the grip member 125 about the film hinge 125*a* so as to rise it from the flat position shown in FIGS. 14*e* and 14*f* to the position shown in FIGS. 14*c* and 14*d*. Consequently, only after releasing this tamper-evident seal the handle member 125 fulfils its function of allowing the user to open and close the lid 120.

The twelfth embodiment of the invention is explained in FIGS. 15*a-j*. FIG. 15*b* shows a plan view of the lid 130 and a line X-X, along which the cut was made, which leads to the sectional view of the lid 130 shown in FIG. 15*a*. The basic structure of the cover 130 with the front wall 131, the edge portion 132, the reinforcement ribs 133, the expansion and intermediate portions 134*a*, 134*b* and the latching ring 139 is analogous to the eleventh embodiment of FIG. 14 (and thus also to the embodiments of FIGS. 4 and 12). As in the case of the eleventh embodiment, the tamper-evidence can be achieved in embodiment 12 in that the lid 130 can snap in the original state, but the user does not find a suitable handle member for pulling up the front wall 131 (in the direction of the arrow in FIG. 15*a*).

Instead of a handle member, the front wall 131 has in its center a slot-shaped recess or trough 135 with a cross-sectional constriction 135*a* on. In the original state shown in FIGS. 15*a* and 15*b*, the user cannot grasp the front wall 121 properly, but must use a tool. This tool is supplied in the form of a handle part 135A-C, whose design and operation will be explained in more detail in FIGS. 15*c-j*. The handle part 135A-C is preferably integrally formed with the lid 131 or the opening wall 2, or glued or spot welded therewith. At a predetermined breaking point, in particular along a perforation, it can be separated therefrom. This is not shown in the drawings, however.

FIG. 15*c* shows the detail F of FIG. 15*a* with a handle part 135A or 1356 anchored in the opening slot 135. As shown in FIGS. 15*d* and 15*e*, the handle part 135A according to a first variant in the lower section can have an opening window 135A' into which the projections of the slot constriction 135*a* engage in order to lock the handle part 135A therein. Instead of the window 135A', the handle part 1356 according to the second variant has only one constriction 135B', as shown in FIGS. 15*f* and 15*g*.

According to a third variant, instead of the constriction 135*a*, the opening slot 135 may also have a cross-sectional widening 135*b* in which a bulge 135C' of a correspondingly shaped handle part 135C engages. This variant is shown in FIGS. 15*h-j*.

In summary, the present invention relates to a cover 10 . . . 130 which operates with a bistable snap-fit mechanism and is intended for positioning on a closable opening 1 of a container or on some other element which is to be closed by the cover. The cover 10 . . . 110 and/or a container wall region 2 have/has fitted thereon a tamper-evident sealing element 18*a* . . . 58*a*; 42*a*; 6*a*; 91*a* . . . 111*a* to be removed when opening the container for the first time, which, prior to being removed, blocks a deformation of the front wall 11 . . . 111 which is necessary for changeover between the two bistable states and/or prevents an expansion portion 74*a* . . . 114*a*, which is necessary for the snap-fit mechanism, from bringing about the alteration to the outer circumference of the cover 10 . . . 110 which is necessary for the deformation of the front wall 11 . . . 111 of the cover between the two bistable states. As an alternative, or in addition, to this, it is also possible for a handle member 125; 135A-C, which is necessary for pulling off the cover 120; 130, to be configured such that it can only be used once the tamper-evident sealing has been successfully removed.

The invention claimed is:

1. A cover for attachment to a container opening to be closed or to another element to be closed by the cover, the cover comprising:

a top wall being deformable in a bistable manner between a first state cambered in a direction of attachment and a second state cambered against the direction of attachment, said top wall having a peripheral edge;

an annular edge portion integrally formed on said peripheral edge of said top wall, said annular edge portion being adapted to effect a clamping attachment of the cover to a wall region of the opening by pressing said annular edge portion in said first state from inside or in said second state from outside against the wall region;

said annular edge portion having at least one expansion portion allowing an outer circumference of the cover to be enlarged in said first bistable state as compared to said second bistable state; and a tamper-evident sealing element removably connected to at least one of the cover or the wall region, said tamper-evident sealing element to be removed upon opening the container for a first time, and said tamper-evident sealing element, prior to its removal, at least one of blocking a deformation of said top wall required for a changeover between said two bistable states or preventing said at least one expansion portion from being deformed for effecting the deformation of said top wall between said two bistable states required for changing said outer circumference of the cover;

said tamper-evident sealing element being formed with at least one reinforcement element mechanically blocking a deformation of said top wall in and against the direction of attachment.

2. The cover according to claim 1, wherein said tamper-evident sealing element is attached to at least one of the cover or the wall region at a location formed of a material, and said material has a predetermined breaking point being a perforated or thinned portion permitting said tamper-evident sealing element to be removed by hand by tearing open said material at said perforated or thinned portion.

3. The cover according to claim 1, wherein said tamper-evident sealing element extends across at least a part of at least one of said top wall or said annular edge portion.

4. The cover according to claim 3, wherein said tamper-evident sealing element is annularly attached or molded along a part or an entirety of an outer circumference of said annular edge portion.

5. The cover according to claim 3, wherein said at least one expansion portion extends to an outermost radial outer edge of the cover and can effect an enlargement of a circumference of said annular edge portion in said first bistable state relative to said second bistable state only after removal of said tamper-evident sealing element.

6. The cover according to claim 3, wherein said tamper-evident sealing element starts from said annular edge portion and extends against the direction of attachment upwards, and a gasket formed of elastic material is attached at an outermost radial edge of the cover.

7. The cover according to claim 1, wherein said at least one reinforcement element is a web extending transversely to said top wall and rising in a rib-shape upwards against the direction of attachment.

8. The cover according to claim 1, wherein said at least one reinforcement element has a substantially flat base member and at least one spacer counteracting a reduction of a distance between said at least one reinforcement element and said top wall.

9. The cover according to claim 1, wherein:

said at least one expansion portion is formed by folds of said edge portion; and said folds are provided at equidistant intervals and are adapted to spread from a folded to a deployed state upon deforming said top wall from said first to said second bistable state when removing said tamper-evident sealing element; and the cover is formed of a one-piece thermoformed or injection molded plastic.

10. A closure system, comprising:

a container having a wall region defining an opening to be closed; and a cover according to claim 1, said cover configured to be clamped against said wall region.

11. The cover according to claim 1, wherein said tamper-evident sealing element is integrally formed with at least one of the cover or the wall region.

12. A cover for attachment to a container opening or another element to be closed by the cover, the cover comprising:

a top wall being deformable in a bistable manner between a first state cambered in a direction of attachment and a second state cambered against the direction of attachment, said top wall having a peripheral edge;

an annular edge portion integrally formed on said peripheral edge of said top wall, said annular edge portion being adapted to effect a clamping attachment of the cover to a wall region of the opening by pressing said annular edge portion in said first state from inside or in said second state from outside against the wall region;

said annular edge portion having at least one expansion portion allowing an outer circumference of the cover to be enlarged in said first bistable state as compared to said second bistable state;

a tamper-evident seal;

a handle member required for removing the cover, said handle member being usable only after overcoming said tamper-evident seal when opening the container for a first time; and said handle member and said top wall having a connection with a predetermined breaking point, said handle member lying flat against said top wall, and said handle member being erectable from a plane of said top wall to become usable for removing the cover only upon removal of said tamper-evident seal by severing said predetermined breaking point.

13. The cover according to claim 12, wherein said predetermined breaking point is a perforated or thinned part of a connection portion.

14. The cover according to claim 12, wherein said handle member, prior to the first opening of the cover, being attached to at least one of the cover or a wall of the opening and only being able to be separated therefrom by overcoming said tamper-evident seal.

15. A cover for attachment to a container opening to be closed or to another element to be closed by the cover, the cover comprising:

a top wall being deformable in a bistable manner between a first state cambered in a direction of attachment and a second state cambered against the direction of attachment, said top wall having a peripheral edge;

an annular edge portion integrally formed on said peripheral edge of said top wall, said annular edge portion being adapted to effect a clamping attachment of the cover to a wall region of the opening by pressing said annular edge portion in said first state from inside or in said second state from outside against the wall region;

said annular edge portion having at least one expansion portion allowing an outer circumference of the cover to be enlarged in said first bistable state as compared to said second bistable state;

a tamper-evident sealing element removably connected to at least one of the cover or the wall region, said tamper-evident sealing element to be removed upon opening the container for a first time, and said tamper-evident sealing element, prior to its removal, at least one of blocking a deformation of said top wall required for a changeover between said two bistable states or preventing said at least one expansion portion from being deformed for effecting the deformation of said top wall between said two bistable states required for changing said outer circumference of the cover;

a transition region between said top wall and said edge portion;

a reinforcement region provided in said transition region, said reinforcement region ensuring that said top wall merges into said edge portion at a constant angle being of identical size in said first bistable state and in said second bistable state; and said reinforcement region being formed at said transition from said top wall to said edge portion by at least one of:

reinforcement ribs extending in a radial direction, or a material thickness at least in partial areas of an outer circumference of said top wall being greater than in a remaining area of the cover, or said top wall having a portion being at least predominantly formed of a first material component, the cover being formed at least in some areas of a second material component being harder than said first material component.

16. A cover for attachment to a container opening to be closed or to another element to be closed by the cover, the cover comprising:

a top wall being deformable in a bistable manner between a first state cambered in a direction of attachment and a second state cambered against the direction of attachment, said top wall having a peripheral edge;

an annular edge portion integrally formed on said peripheral edge of said top wall, said annular edge portion being adapted to effect a clamping attachment of the cover to a wall region of the opening by pressing said annular edge portion in said first state from inside or in said second state from outside against the wall region;

said annular edge portion having at least one expansion portion allowing an outer circumference of the cover to be enlarged in said first bistable state as compared to said second bistable state;

a tamper-evident sealing element removably connected to at least one of the cover or the wall region, said tamper-evident sealing element to be removed upon opening the container for a first time, and said tamper-evident sealing element, prior to its removal, at least one of blocking a deformation of said top wall required for a changeover between said two bistable states or preventing said at least one expansion portion from being deformed for effecting the deformation of said top wall between said two bistable states required for changing said outer circumference of the cover;

said top wall having said at least one expansion portion and a remaining edge portion;

at least one of said remaining edge portion or said tamper-evident sealing element being made of a first material component;

said at least one expansion portion being made of a second material component being softer than said first material component; and the cover being formed of a one-piece injection-molded multi-component technology plastic.

* * * * *